US005594244A

United States Patent [19]

Prutton

[11] Patent Number: 5,594,244

[45] Date of Patent: Jan. 14, 1997

[54] ELECTRON ENERGY SPECTROMETER

[75] Inventor: Martin Prutton, York, Great Britain

[73] Assignee: University of York, York, Great Britain

[21] Appl. No.: 406,875

[22] PCT Filed: Sep. 15, 1993

[86] PCT No.: PCT/GB93/01957

§ 371 Date: Jun. 12, 1995

§ 102(e) Date: Jun. 12, 1995

[87] PCT Pub. No.: WO94/07258

PCT Pub. Date: Mar. 31, 1994

[30] Foreign Application Priority Data

Sep. 23, 1992 [GB] United Kingdom ..... 9220097

[51] Int. Cl.[6] ..... H01J 49/48

[52] U.S. Cl. ..... 250/305

[58] Field of Search ..... 250/305

[56] References Cited

U.S. PATENT DOCUMENTS

| | | | |
|---|---|---|---|
| 3,735,128 | 5/1973 | Palmberg | 250/305 |
| 4,126,781 | 11/1978 | Siegel | 250/305 |
| 4,983,864 | 1/1991 | Murai et al. | 250/492.2 |

FOREIGN PATENT DOCUMENTS

| | | | |
|---|---|---|---|
| 0470478 | 2/1992 | European Pat. Off. . | |
| 57-189447 | 11/1982 | Japan | 250/305 |
| 2183898 | 6/1987 | United Kingdom . | |
| 8906044 | 6/1989 | WIPO . | |

OTHER PUBLICATIONS

D. F. C. Brewer, "A Coaxial Cone Electrostatic Velocity Analyzer 1, Analysis of Electron Optical Properties" Journal of Physics E. Scientific Instruments, vol. 13, 1980, Bristol GB, pp. 114–122. no month.

S. Yavor, et al., "Optics of Conical Electrostatic Analysing and Focusing System", Nuclear Instruments and Methods, vol. A298, 1990, Amsterdam NL. pp. 421–425. no month.

International Search Report, dated Jan. 13, 1994, Appl. No. PCT/GB93/01957.

International Search Report, Appl. No. PCT/GB93/01957.

D. F. C. Brewer, et al., "A Coaxial Cone Electrostatic Velocity Analyzer I. Analysis of Electron Optical Properties", The Institute of Physics, 1980. no month.

S. Ya. Yavor, et al., "Optics of Conical Electrostatic Analysing and Focusing Systems", Nuclear Instruments and Methods in Physics Research A298 (1990), pp. 421–425. no month.

*Primary Examiner*—Jack I. Berman

*Attorney, Agent, or Firm*—Loeb & Loeb LLP

[57] ABSTRACT

A sample (2) is mounted in a sample holder (13) with a surface (3) of the sample (2) normal to the axis (4) of a pair of truncated electrically conductive frusto-cones (5, 6) which are coaxial and whose apexes meet at the sample surface (3). An exciting source (7) is mounted within the inner cone (5), which is solid and is maintained at ground potential to serve as a first electrode. The outer cone (6) is made of high transparency metallic mesh and is maintained at a positive potential +V (e.g. 1000 v) with respect to the sample surface (3), to serve as a second electrode. These components of the spectrometer (1) are contained within a vacuum system (15), and the potentials are applied to the cones (5, 6) by a biassing means (14). Electrons generated where the beam from the exciting source (7) strikes the sample are emitted into $2\pi$ steradians towards an entrance annulus (8). A small fraction of these electrons enter the entrance annulus (8) and find themselves in an electric field which deflects them towards the mesh of the outer cone (6). Electrons of a fixed kinetic energy leaving the sample (2) and entering the annulus (8) are accelerated towards the outer cone (6) on trajectories which will intersect. Those electrons that pass through the outer cone (6) enter a region of field-free space, in which their straight-line trajectories intersect on the surface of a third cone (11, FIG. 2), which is the focal locus of the spectrometer. As electrons of fixed kinetic energy enter the spectrometer through the annulus (8) between the cones (5, 6) they are focused into a ring on the focal locus.

18 Claims, 2 Drawing Sheets

ELECTRON ENERGY SPECTROMETER

This invention relates to electron spectrometers.

Electron spectrometers are in widespread use for the study of gases, liquids and solids in both academic and industrial contexts. Their most widespread use is in the characterisation and quantitative analysis of the surfaces of solids. In the semiconductor technology industry, they are used to estimate the state of cleanliness of a surface before, during and after a large variety of different kinds of process steps during the production of integrated circuits. They are used also in the chemical industry to help establish manufacturing processes for catalysts and polymers, and in the metallurgical industries to establish conditions for surface treatments for low friction coefficients, low corrosion in hostile ambient conditions and production of strongly adhering coatings.

The dominant spectrometer in these areas is the coaxial mirror analyser (or CMA). This is a relatively simple instrument which consists essentially of a pair of coaxial metal cylinders which are maintained at different electrostatic potentials. A sample is mounted on the common axis of these cylinders and is bombarded by electrons or photons from a source which can be mounted within the inner cylinder. Electrons excited by the photo-electric effect or the Auger effect leave the sample and enter the coaxial cylinders. If they have a kinetic energy appropriate to the dimensions of the structure and the voltages applied, then they are focused onto an aperture and pass through to an electron multiplier where they are converted into an electrical signal which can be as analog current or pulses which can be counted. The energy distribution of the electrons leaving the sample can be observe by sweeping the voltage on the outer cylinder of the CMA so that electrons of varying kinetic energies are detected at the electron multiplier. Only one narrow range of kinetic energies is detected at one time and so the spectrum is swept sequentially.

This type of spectrometer has been very successful because:

(i) It is very simple in comparison to others and so it is relatively cheap to manufacture.

(ii) The exciting source is mounted inside the spectrometer itself which leads to a compact structure which can be secured to an experimental chamber by a single flange. This means that the whole assembly can be accurately prealigned during manufacture so giving good control of the properties of the entire instrument.

(iii) The single flange design allows other experimental apparatus to be added with a straight line path from the sample to the additional apparatus.

EP 0 470 478 discloses a type of CMA spectrometer.

A second kind of spectrometer, the concentric hemispherical analyser (CHA), has also become popular over the last few years. This is based upon a pair of concentric hemispheres or sections of hemispheres accessed by coaxial cylinder electrostatic lenses. This is a much more complex type of spectrometer, which may require anything between 5 and 15 voltages to be varied as a spectrum is collected. However, it has better energy resolution than the CMA, gives more space around the specimen and can be configured electrically to operate in a variety of modes. The CHA has found favour in research and development laboratories because of this flexibility and the excellent energy resolution that is possible. CHA instruments normally collect a single kinetic energy and at one time and so are swept sequentially like a CMA to collect an electron spectrum. Since this kind of spectrometer is double focusing, it is possible to place an array of electron multipliers at its output and collect several kinetic energies (or channels) simultaneously and so speed up the acquisition of data. This was first done by placing nine channel electron multipliers at the output of a CHA, so speeding up acquisition by a factor of nine. Subsequently, manufacturers have included either separate multipliers (e.g. five) or micro-channel plates with multiple collectors (e.g. sixteen) is order to improve the single channel restriction of the simplest form of CHA. However, it has not been possible to span more than about 50 eV of a spectrum at one time by adding such multiple detectors. This is because of the maximum energy range presented by the hemispheres themselves at their output. Electrons of high kinetic energy strike the outer hemisphere and those of low energy strike the inner hemisphere and so both of these groups are lost to the detectors.

Because of the need to collect spectra sequentially, the total time required to collect a spectrum may be anything between a few seconds and several hours for an 8000 point spectrum, depending upon the energy resolution and the type of exciting source being used. Thus, fast experiments must be confined to very narrow energy ranges and important new features cropping up in a spectrum can be missed. Further, whole areas of application like single button operation for whole spectrum acquisition on a quality controlled production line are quite impossible.

In the publication "Phys. E: Sci. Instrum." by The Institute of Physics, Vol 13, 1980, pages 114–127, there is disclosed a coaxial cone electrostatic velocity analyser, in which the cones have parallel walls. In the publication "Nuclear Instruments and Methods in Physics Research", A298 (1990), pages 421–425, there are disclosed conical analysers with both parallel and diverging electrodes. In both of these disclosures, however, the principal of focusing the electrons follows the established trend in the art. That is, the electrodes are opaque to electrons, and formed with local slits through which electrons having a narrow band of energies pass, to be focused. They are essentially topological variations of the basic coaxial mirror analyser (CMA), and are incapable of focusing simultaneously electrons over a wide range of energies.

Preferred embodiments of the present invention aim to provide electron spectrometers which can be used to detect a wide energy range simultaneously, so that the entire electron spectrum over the important and useful range from 20 to 2000 eV can be observed at once. Certain embodiments of the invention aim to achieve this, using a conventional thermionic electron gus to excite the sample, in times of the order of 50 msecs and less.

According to a first aspect of the present invention, there is provided a spectrometer comprising a sample holder, an excitation source, first and second electrodes, biasing means and a detector, wherein:

the excitation source is arranged to emit an excitation beam to a sample in said holder thereby to cause electron emission from the sample;

the biasing means is arranged to establish an electric field between said electrodes;

said electrodes are conical or part-conical in shape and are coaxial with one another;

there is defined between adjacent ends of said electrodes a gap adjacent said sample holder to receive electrons emitted from a sample in the holder, in use;

said electrodes diverge from one another in a direction extending away from said sample holder, and said detector diverges from said electrodes in a direction extending away from said sample holder, with the second electrode disposed between the first electrode and the detector; and in a region where said electrodes diverge from one another and said detector diverges from said electrodes, the second electrode is at least partially transparent to electrons such that, in use, electrons entering said electric field through said gap are deflected to pass through the second electrode and impinge upon the detector, which is operative to detect the impinging electrons.

Preferably, said electrodes are frusto-conical.

Preferably, the apexes of the respective cones of said electrodes meet at or adjacent a surface of a sample when held in said sample holder.

Preferably, the detector has a shape which is similar to that of said electrodes.

Preferably, the detector is coaxial with said electrodes.

A spectrometer as above, in accordance with the first aspect of the invention, may further comprise a first screen which is disposed between said second electrode and detector, and is arranged to be biassed to the same potential as said second electrode.

Preferably, the first screen has a shape which is similar to that of said detector and electrodes.

Preferably, the first screen is coaxial with said detector and electrodes.

A spectrometer as above, in accordance with the first aspect of the invention, may further comprise a second screen which is disposed between said first screen and detector, and is arranged to be biassed to a potential which is negative with respect to that of said first screen.

Preferably, the second screen has a shape which is similar to that of said first screen, detector and electrodes.

Preferably, the second screen is coaxial with said first screen, detector and electrodes.

Said detector may include a light-emitting screen and means for detecting said light.

Preferably, said detector includes an array of charge-coupled devices.

A spectrometer as above, according to the first aspect of the invention, may include processing means for receiving from said detector signals representing the distribution of electrons in said detector, and for processing said signals to provide a spectrum of the energy levels of said electrons.

According to a second aspect of the present invention, there is provided an interface for use between first and second electric field regions, comprising a plate having first and second surface portions which border said first and second regions respectively, at least said first surface portion comprising an electrically resistive material the resistance of which varies over said surface portion so as to terminate and match over said surface portion equipotentials in the first electric field region.

Said second surface portion may comprise an electrically conductive portion, to provide a termination where the electric field in said second region is a zero field.

The invention extends to use of an interface according to the second aspect of the invention to terminate equipotential sin at least one electric field region, comprising the steps of placing the interface between first and second electric field regions, and terminating the equipotentials in said first electric field region by means of said electrically resistive material on said first surface portion, in such a manner as to match the potentials on said first surface portions with said equipotentials.

According to a third aspect of the present invention, there is provided electron deflection apparatus comprising:

a pair of electrodes defining a space therebetween;

means for establishing an electric field in said space;

means for defining a gap between said electrodes, which means comprises an interface according to the second aspect of the invention, the plate of which projects into said space to define said gap between one of said electrodes and an end of said plate; and means for emitting electrons through said gap into said space.

Said plate may be disposed at adjacent ends of said electrodes.

Said apparatus may be a spectrometer—which may be as above, is accordance with the first aspect of the invention.

The invention extends to use of a spectrometer according to any of the foregoing aspects of the invention to carry out a spectral analysis of a sample, comprising the steps of:

holding the sample in the sample holder;

emitting an excitation beam from the excitation source to the sample in said holder thereby to cause electron emission from the sample;

establishing an electric field between said electrodes by means of the biasing means;

detecting, by means of the detector, electrons which enter said electric field through said gap and are deflected to pass through the second electrode and impinge upon the detector; and processing signals received from said detector to provide a spectrum of the energy levels of the electrons that have impinged upon sad detector.

For a better understanding of the invention, and to show how the same may be carried into effect, reference will now be made, by way of example, to the accompanying diagrammatic drawings, in which.

Figure 1:
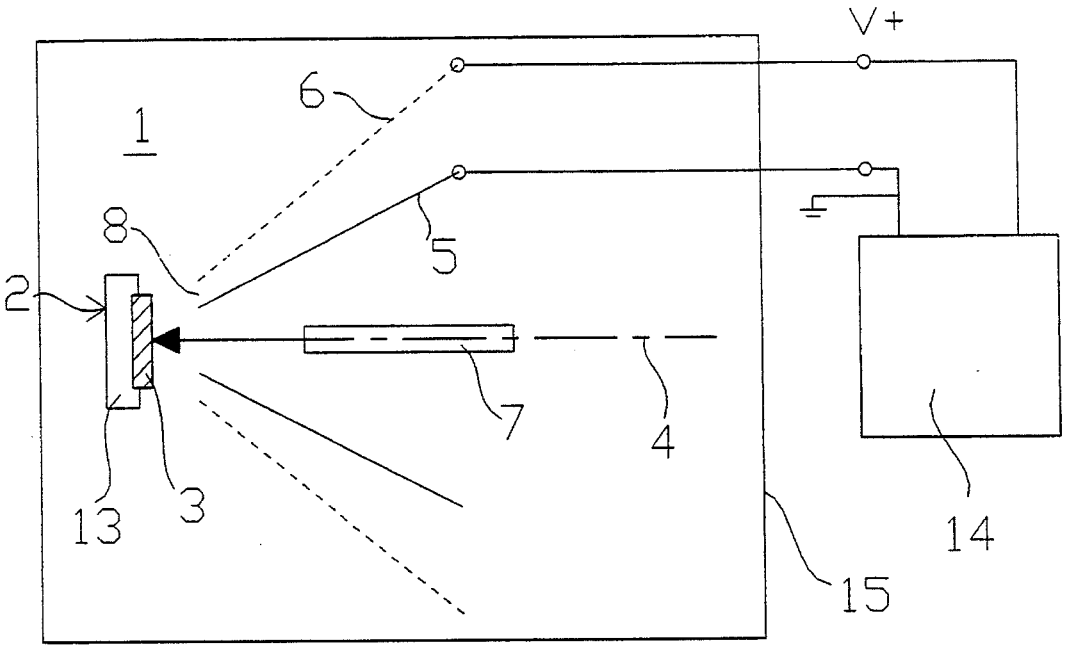
FIG. 1 is a schematic longitudinal sectional view of the principal components of one example of as electron spectrometer embodying the present invention.

In the spectrometer 1 shown in FIG. 1, a sample 2 is mounted in a sample holder 13 with a surface 3 of the sample 2 normal to the axis 4 of a pair of truncated electrically conductive cones 5, 6 which are coaxial and whose apexes meet at the sample surface 3. (For convenience, frusto-cones such as 5, 6 may hereinafter be referred to simply as cones.) An exciting source 7, which may be, for example, as electron gun or a photon source, is mounted within the inner cone 5, which is solid and is maintained at ground potential to serve as a first electrode. The outer cone 6 is made of high transparency metallic mesh and is maintained at a positive potential +V (e.g. 1000 v) with respect to the sample surface 3, to serve as a second electrode.

These components of the spectrometer 1 are contained within a vacuum system 15, in a manner which is in itself generally well known in the art. The potentials are applied to the cones 5, 6 by a biassing means 14, which may be located outside the vacuum system 15.

Electrons generated where the beam from the exciting source 7 strikes the same are emitted into $2\pi$ steradians towards an entrance annulus 8 of the spectrometer, defined between the ends of the cones 5 and 6. A small fraction of these electrons enter the entrance annulus 8 and find themselves in an electric field which deflects them towards the mesh of the outer cone 6. Electrons of a fixed kinetic energy leaving the sample 2 and entering the annulus 8 are accelerated towards the outer cone 6 on trajectories which will intersect. Those electrons that pass through the outer cone 6 enter a region of field-free space, in which their straight-line trajectories intersect on the surface of a third cone, which is the focal locus of the spectrometer. A detector assembly can be placed on this focal locus. As the electrons of fixed kinetic energy enter the spectrometer through the annulus 8 between the cones 5, 6 they are focused into a ring on the focal locus.

A simple detector which can be placed at the focal locus is a fluorescent phosphor screen which can be viewed through a vacuum window by a closed circuit TV camera. The electrons reaching this screen are accelerated after they have passed through the field-free space where they are focused, in order that fluorescence in the phosphor of the screen can be excited.

Figure 2:
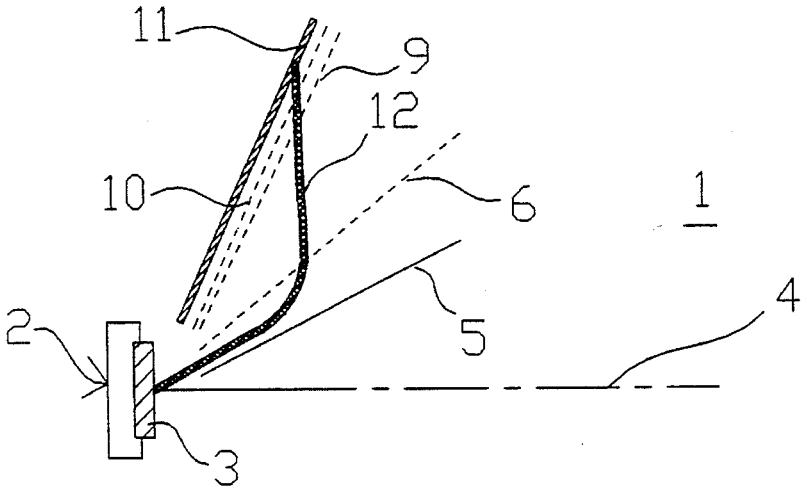
FIG. 2 is an enlarged partial view of the spectrometer of FIG. 1, showing the upper part of the spectrometer above a longitudinal axis of symmetry, with additional components.

Such a simple version of the spectrometer 1 is sketched in FIG. 2, where there are now two extra conical grids 9, 10 between the outer cone 6 and the fluorescent screen 11. The grid 9 is at the same potential as the outer cone 6 (e.g. +1000 V) and it ensures that the electrons move in field-free space having left the outer cone 6. The grid 10 is placed at a potential (e.g. +500 V) which is negative with respect to the grid 9, and forms a high-pass filter between the grid 9 and the fluorescent screen 11, which is maintained at about 5 kV. The grid 10 is desirable because those electrons which happen to strike the metal of the outer cone 6 will cause secondary electron emission. These secondaries could reach the fluorescent screen 11 and give an unwanted background to the spectrum and so they should be rejected. By placing the grid 10 at a potential which is negative with resect to the outer cone 6, the secondaries will be rejected by turning them around before they reach the screen 11.

Thus, the whole spectrometer 1 consists, in this example, of the sample 2 (in its holder), the excitation source 7 and the assembly of the five coaxial frusto-conical components 5, 6, 9, 10 and 11, all contained within a vacuum system. In the first instance, detection can be carried out using, for instance, a TV camera outside the vacuum system viewing the fluorescent screen through a vacuum window. The whole assembly can be mounted like a CMA. However, unlike a CMA, the whole spectrum can be made to appear on the fluorescent screen 11 at once, and it can be converted to electrical form in a single TV frame scan time.

Further practical aspects of the above-described spectrometer 1 may be as follows.

The outer cone 6 may be made of stainless steel woven mesh of high (e.g. 80%) transparency.

The secondary electron generation processes at the mesh of the outer cone 6 should not be allowed to interfere significantly with the energy analysed electrons being focused by the spectrometer on the screen 11. The grids 9 and 10 form the high-pass filter which rejects these secondaries. The arrangement of these grids requires careful design to ensure that they are close to the detection plane of the screen 11, and yet do not suffer from field electron emission. The formed grids may be electropolished and then coated with gold to provide a smooth surface of constant work function.

The secondary electron generation processes at the end of the cones 5, 6 remote from the sample 2 have to be considered carefully because the equipotentials must be terminated here. This depends very much on the choice of the ratio of the overall length of the cones 5, 6 to the useful length through which energy analysed electrons will pass. The greater this ratio, the smaller the fraction of secondaries will reach the screen 11.

Figure 4:
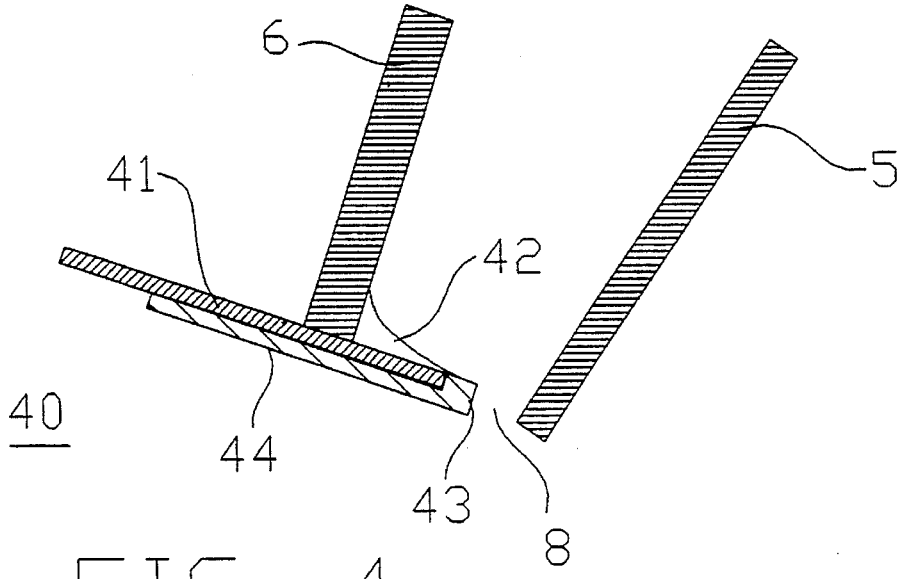
FIG. 4 is a detail view of an example of a conical entrance annulus of the spectrometer of FIGS. 1 and 2.

An important component is a tapered resistive film entrance aperture 40 which matches field-free space to the conical equipotentials inside the cones 5, 6—as is illustrated in FIG. 4 and described later in more detail below.

A TV camera may be provided to collect the light from the fluorescent screen 11, and may be interfaced to a computer to extract spectra by circular averaging of the image. Such cameras, respective control boards and device handling software are all available commercially at the present time.

It is not necessary, however, to convert electrons to light and then back to electrons for display, storage and processing. Thus, instead of the fluorescent screen 111 which is monitored by a TV camera under computer control, there may alternatively be employed an integrated detector array—that is, a device to detect charge directs at the focal locus of the spectrometer. This may reduce sensitivity to ambient lighting levels, allow the realisation of the shot-noise limited statistics in the electron detection, and facilitate simple direct interfacing to a control computer. A variety of detectors may be considered for this.

A conventional solution would be to use a pair of channel plates and an array of metallic strips behind them to collect the amplified charge. However, this may be very difficult in practice, because a conical focal locus would require the development of a conical microchannel plate assembly. A special case of the general conical geometry is possible with a plane circular focal locus. Such a special design could be used with commercial available microchannel plate assemblies. In both cases the output strips would have be brought individually through the vacuum wall. Bringing 1000–8000 separate high speed, low signal level leads through a UHV wall is not an easy proposition.

Another approach would be to use a pair of conical or planar micro-channel plates followed by a resistively encoded position sensitive detector. This would bring the number of output leads down to 4 but is unlikely to have the dynamic range required to resolve as many as 1000 channels. It would still require the development of the conical channel plate assembly.

A preferred approach is to use an integrated array of charge-coupled devices (CCD's) together with a fast multiplexer. Chips for this detector might be fabricated as flat triangular shapes which would be mounted and interconnected as a frusto-conical assembly to replace the screen 11.

A detailed description of the sample holder 13 is not essential to an understanding of the invention. The purpose of the sample holder 13 is to hold the sample 2 to be analyzed in a desired location. This will usually be at the apexes of the conical electrodes 5, 6 ( or where their apexes would meet, if they were not frusto-cones), although the sample may be disposed at other locations if desired—usually on the axis 4, but possibly to either side of it, and/or to the right or to the left of the position as seen in FIG. 1.

Thus, many possible forms of the sample holder 13 will be apparent to the worker skilled in the art. As will also be understood by the worker skilled in the art, the term "sample holder" may include means for presenting any sample to be analysed at the desired location. For example, if a gas is to be analysed, the "sample holder" may comprise a gas flow cell, to present a flowing stream of gas to be analysed at the apexes of the cones 5, 6 (or other desired location).

Although the cones 5, 6 are preferably frusto-cones, to enable the sample 2 to be placed at their coincident apexes, they may alternatively be full cones, in which case the sample would be placed to the right of the position as seen in FIG. 1.

A more detailed theoretical consideration of the spectrometer 1, and modifications thereof, will now be given.

Consider a pair of metallic cones ( such as the cones 5, 6) with their common apexes at the source of electrons. The inner and outer cones are maintained at $V_1$ and $V_2$ and have cone semi-angles $\theta_1$ and $\theta_2$ respectively. Laplace's equation is soluble in spherical polar coordinates for this configuration and so equations for the electrostatic potential V(r, θ) and the electric field E(r, θ) can be found. They are:

$$V(\theta) = V_1 - (V_1 - V_2)\left\{ \frac{Z_1 - Z}{Z_1 - Z_2} \right\} \quad (1)$$

In these equations, the quantity Z is related to the polar angle θ by:

$$E(\theta) = \frac{2(V_1 - V_2)}{(Z_1 - Z_2)} \cdot \frac{1}{r\sin(\theta)} \quad (2)$$

$$Z(\theta) = \ln[(1 + \cos(\theta))/(1 - \cos(\theta))] \quad (3)$$

$Z_1$ and $Z_2$ are thus the values of Z at the cone surfaces where θ is $\theta_1$ or $\theta_2$. It can be seen that V is independent of r and so the equipotentials between the cones are themselves conical surfaces. The magnitude of the field E is such that is falls off as 1/r away from the electron source and it is circumferential in sense.

The trajectories of electrons leaving the sample 2 can be calculated if it is assumed that they travel in straight lines towards the cones 5, 6 which start at a distance $r_0$ from the origin where the analytic field in Equation (2) turns on abruptly. They then move in curved trajectories towards the most positive cone. If the outer cone 6 is the most positive, as shown in FIG. 2, then the coordinates of the point where a ray of given kinetic energy cuts the outer cone 6 can be calculated analytically. The electron then moves in a straight line in the field-free space between the outer cone 6 and the inner grid 9. A typical electron trajectory 12 is shown in FIG. 2.

If an annular cone of electron trajectories is admitted to the volume between the cones 5, 6, then the straight line paths outside the outer cone 6 do not cross at a single point. However, they do cross within a narrow region (the focal point for those rays), the width and position of which can be found by numerical least squares analysis of a set of paths within the entrance annulus.

We have done this by means of a computer program, and found the surface joining the focal points for a set of kinetic energies of electrons entering the spectrometer 1. We have also plotted the trajectories of the electrons through the cones and the foal locus. We have used an entrance annulus defined by the suer and containing 21 beams launched at different directions into the spectrometer within this annulus. The kinetic energy range of electrons within the annulus can be divided into up to 50 discrete energies so that the energy dispersion and resolution can be examined in detail.

Using this program, the focusing properties of the spectrometer have been examined as a function of the angle between the cones, the semi-angle of the inner cone, the cone lengths and the distance $r_0$ between the sample and the start of the cones. An important objective in this exploration has been to find a focal locus which is as near to a plane as possible in order to simplify the fabrication of the detector. Further, solutions were sought which did not cause the electrons with low kinetic energies to focus to the left of the sample surface 3 as drawn in FIG. 2. This is because it was wished that the structure of the spectrometer does not obstruct access to the sample 2. It was discovered that the best resolution was always obtained if the entrance annulus was defined so as to cause electrons to enter the volume between the cones very near to the inner cone.

A spectrometer with good resolution, a focal locus always to the right of the sample surface 3 and a nearly flat conical focal locus as found to have the specification given in Table 1.

TABLE 1

| SPECTROMETER SPECIFICATION | |
|---|---|
| Configuration | |
| Inner Cone semi-angle, $\theta_1$ | 53 deg |
| Outer Cone semi-angle, $\theta_2$ | 67 deg |
| Inner Cone potential, $V_1$ | 0 volts |
| Outer Cone potential, $V_2$ | 1000 volts |
| Overall cone length, L | 60 mm |
| Clear radius to spectrometer, $r_0$ | 10 mm |
| Entrance annulus | 54–56 deg |
| Properties | |
| Resolution | 1003 |
| Solid angle collected | 2.9% of 2π sr |
| Focal plane | y = 4.9x + 11 |
| Mean Dispersion | 16 μm $eV^{-1}$ |

Figure 3:
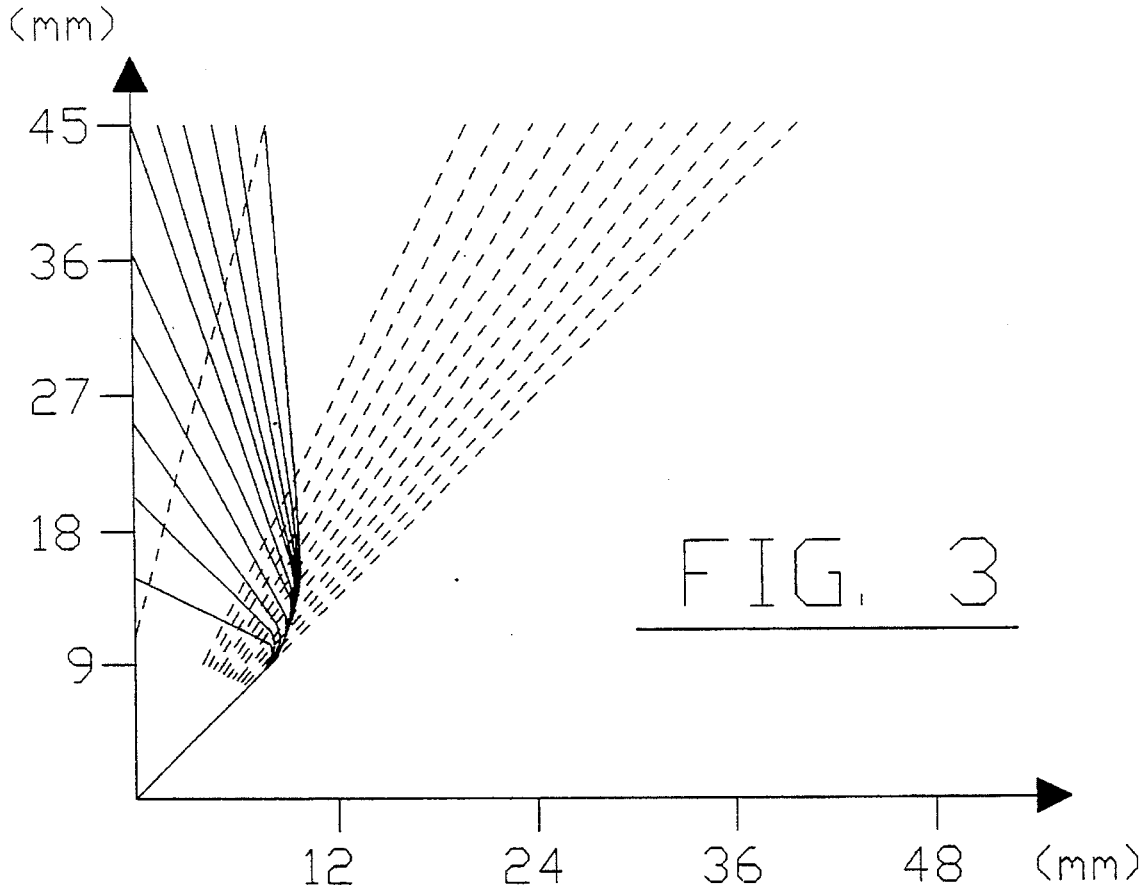
FIG. 3 is diagram illustrating the trajectories of electrons of differing energies through a spectrometer of the type of FIG. 1 and 2.

A diagram of the trajectories of eleven electron beams from 50 eV to 2050 eV, through the spectrometer of Table 1, is shown in FIG. 3, which shows that the focal locus is a cone containing the straight line with positive slope passing through approximately (0, 11).

The spectrometer is an approximately constant resolving power device in that the diameter of the focus increases linearly with the kinetic energy of the electrons being passed. Also, the radial distance along the focal plane of the focal position increases approximately linearly with kinetic energy. These effects mean that the intensity of the fluorescent screen 11 at the focal plane will be proportional to EN(E) where N(E) is the energy distribution of the electrons leaving the sample 2. This is similar to the nature of a spectrum detected using a CMA.

Table 2 below is similar to Table 1, but shows another spectrometer with an even flatter focal locus.

TABLE 2

| SPECTROMETER SPECIFICATION | |
|---|---|
| Configuration | |
| Inner Cone semi-angle, $\theta_1$ | 67 deg |
| Outer Cone semi-angle, $\theta_2$ | 79 deg |
| Inner Cone potential, $V_1$ | 0 volts |
| Outer Cone potential, $V_2$ | 1000 volts |
| Overall cone length, L | 90 mm |
| Clear radius to spectrometer, $r_0$ | 20 mm |
| Entrance annulus | 68–69.5 deg |
| Properties | |
| Resolution | 1335 |
| Solid angle collected | 2.4% of 2π sr |
| Focal plane | y = 267.5 + 69.2x |
| Mean Dispersion | 23 μm $eV^{-1}$ |

Realisation of the attractive design of the spectrometer of Table 1 or 2 requires that the field-free region between the sample 2 and the entrance annulus 8 to the cones 5, 6 be matched to the conical equipotentials inside the cones 5, 6. In addition, the entrance annulus 8 has to be defined to give the appropriate annular cone angle. Inspection of Equation (3) reveals that the logarithmic cosine function Z is what determines the variation of the potential in the θ direction. A plot of this function for the spectrometer of Table 1 would show that the potential varies very nearly linearly with θ in the range 50°≦θ≦70°. Clearly, a metallic aperture closing the front ends of the cones 5, 6 (except for the entrance annulus 8) would not terminate the equipotentials correctly and the low kinetic energy electrons would move on paths very from the analytic case described above. Indeed, an investigation of the effects of apertures has shown the distortion of the equipotentials near a grounded simple metallic aperture to be clearly unacceptable.

A novel alternative structure for the entrance annulus 8 may be provided by an insulating sheet coated with a film of a good conductor (gold would be suitable) on the side of the sample and a thin resistive film on the side facing the insides of the cones 5, 6. Such an aperture plate 40 is shown in FIG. 4.

In FIG. 4, a thin glass cone 41 is formed on a carbon former. After cleaning, the outer surface of the cone 41 is coated with a tapering silicon film 42 of about $10^9$ ohms resistance by vacuum evaporation through the adjustable iris. Control of the iris provides the desired thickness profile. The inside of the cone 41 and the outer wall 43 of the entrance annulus 8 are coated with a high conductivity gold film 44 which, in use, is grounded on the side facing the sample 2, so allowing electrons to move in field-free space from the sample 2 to the entrance annulus 8.

If a resistive film of uniform thickness were evaporated on the outside of the conical aperture plate 41 of FIG. 4, it would have a potential distribution along its surface given by:

$$V(\theta) = (V_2 - V_1)\left\{\frac{\ln\left(\frac{r_0\theta}{r_1}\right)}{\ln\left(\frac{\theta_2}{\theta_1}\right)}\right\} \quad (4)$$

This is clearly not linear as needed. A good approximation to the spacing of the equipotentials inside the cones can be achieved by tapering the thickness of the annular resistive film 42 in such a way that its thickness varies as the reciprocal of the distance between the outer wall 43 of the entrance aperture 8 and the inner surface of the outer cone 6. In this case, the potential along the surface of the resistive film 42 becomes:

$$V(\theta) = (V_2 - V_1)\left\{\frac{R - R_1}{R_2 - R_1}\right\} \quad (5)$$

In equation (5), the distance R is simply the radial distance from the axis of the conical aperture plate 41 to the point where the potential is being measured.

A finite element calculation for this tapered resistive film aperture shows that the disturbance of the equipotentials is not very much smaller and is acceptable.

If a resistive film aperture of this design is to be used in practice, then one important consideration is the power dissipated in the aperture (it is connected across 1000 volts in the spectrometer 1) and the power dissipated in the voltage supply providing the cone potentials. To restrict the power consumption to 1 mW and so have negligible aperture heating, the tapered film needs to go from 110 nm thick at the outer cone 6 to 90 nm thick near the inner cone 5 and have a resistivity of about 25 ohm.cm. This may be realised if the silicon film 42 is of polycrystalline silicon evaporated onto the aperture plate 41.

An estimate of the current reaching the focal plane can be made as follows. Consider excitation by a 5 keV beam of electrons and a beam current of 1 μA. If the secondary electron yield of the sample is 1 (numbers between 0.8 and 5 occur in practice) and the analyser accepts 2.8% of 2π or then a total current of $2.8\times10^{-8}$ A enters the cones 5, 6. If the energy distribution of the secondary electrons is approximated as being flat from zero eV to the primary energy, then the current density is $5.6\times10^{-12}$ A per eV. The spectrometer 1 has an average energy window of 2 eV and so the means current detected at the fluorescent screen 11 or the alternative integrated detector will be about $10^{-11}$ A for each energy channel.

This is sufficient to excite visible fluorescence in a screen (electron microscopes often work with $10^{-12}$ A) and so should give a measurable intensity for a TV camera. For an integrated detector this corresponds to an arrival rate of about $6\times10^7$ electrons per second or a charge of about $10^{-13}$ C in a 10 msec data acquisition time. Such a charge is easily detectable with a CCD device.

Thus the results of the above analysis show that a spectrometer such as the spectrometer 1, with a resistive film aperture such as that shown in FIG. 4, may collect 3% of 2π steradians for analysis and separate electrons with kinetic energies between 50 and 2050 eV into 1000 channels with an energy resolution of about 2 eV per channel. This compares very favourably with both CMA and CHA known spectrometers. Thus, a CMA may typically collect 10% of 2π steradians but only 1 channel. A CHA may collect 2% of 2π steradians and only 16 channels at the best. If the dwell time per channel is 10 msecs ( a realistic practical figure) then a CHA may be 23.2 times faster than a CMA, but a spectrometer such as the spectrometer 1 may be 330 times faster.

Other comparisons are possible. For example, a spectrometer such as the spectrometer 1 but collecting 0.7% of 2π steradians may have approximately a 0.1 eV energy resolution whilst collecting 8000 channels between 50 and 2050 eV simultaneously. This is very significantly better than either a CMA or a CHA and would be an extremely useful instrument in a wide variety of applications.

In the illustrated embodiments of the invention, the conically shaped electrodes, girds and screens may be full cones (or frusto-cones), in the sense that they subtend a full 360°. however, in alternative embodiments, they may subtend less than 360°. For example, they may be half-cones (or frusto-cones) subtending 180°, quarter cones (or frusto-cones) subtending 90°, or any other fraction of full 360° cones (or frusto-cones). This may facilitate access to components of the spectrometer.

It is important that the cone 6 is at least partially transparent to electrons, so that they may pass through the cone 7 to impinge upon the detector. For the avoidance of doubt, the term "at least partially transparent" means that any given area of the transparent material will allow a significant proportion of electrons reaching the electrode to pass through it—as opposed to an opaque material which is substantially impervious to electrons, but which is formed with one or more small local aperture (e.g. a slit) to act as a mask, and allow electrons to pass freely through only that aperture.

In the foregoing examples, the cone may be of a very fine mesh having a high degree of transparency to electrons—e.g. about 80%. As will be understood by the worker skilled in the art, the wires of fibres of the mesh will tend to collect electrons that collide with them, and thus provide the smaller degree of opacity (e.g. about 20%) of the mesh.

the cone 6 may be of alternative materials—e.g. complex solids which have an intrinsic degree of transparency to electrons. Usually, the transparency of the material will be uniform over the full area of the cone 6—although certain areas (e.g. at supports) may be locally more opaque or fully opaque. It is possible also for areas of the cone 6 to be more or fully opaque where no electron transmission is expected or desired. The main thing is to allow a sufficiently large area of transparency to allow electrons over a wide band of energies (preferably all electrons energies that may be expected to be emitted in the spectrometer) to pass through the cone 6—as opposed to, for example, previously proposed spectrometers which allow only one or more narrow ranges of electrons to be focused at nay one time.

Preferably, the cone 6 has a transparency of at least 50% to electrons, over areas where electrons may be expected to meet the cone 6.

Advantages arise from having the second cone 6 outside the first cone 5. For example, the size of the focal locus where electrons are detected increases with distance from the axis 4. As mentioned above, at one extreme, the focal locus could be a plane—in which case the detector could have the form of a flat disc (an extreme cone with cone angle of 180°). Indeed, in this case, the detector could be of any shape—even non-symmetrical and/or non-aligned with the axis 4, provided that it were plane and positioned at the focal plane to detect at least part (preferably all) of the electrons focused there. Also, with the second cone 6 outside the first cone 5, connections between the detector and peripheral/ancillary components may be easier.

However, it is possible alternatively to dispose the second (transparent) cone 6 within the first cone 5, with the detector then within the second cone 6. This may provide further protection for the detector, but the focal locus will tend to be smaller, and connections to the detector may be more difficult. In the extreme case, the focal locus of the detector may be a circular cylinder (an extreme cone with cone angle of 0°).

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed in one example only of a generic series of equivalent or similar features.

The invention is not restricted to the details of the foregoing embodiment(s). The invention extends to any novel one, or nay novel combination, of the features disclosed in this specification (including any accompanying claims, abstract and drawings), or to any novel one, or any novel combination, of the steps of any method or process so disclosed.

I claim:

1. A spectrometer comprising a sample holder, an excitation source, first and second electrodes, biassing means and a detector, wherein:

the excitation source is arranged to emit an excitation beam to a sample in said holder thereby to cause electron emission from the sample;

the biassing means is arranged to establish an electric field between said electrodes;

said electrodes are conical or part-conical in shape and are coaxial with one another;

there is defined between adjacent ends of said electrodes a gap adjacent said sample holder to receive electrons emitted from a sample in the holder, in use;

said electrodes diverge from one another in a direction extending away from said sample holder, and said detector diverges from said electrodes in a direction extending away from said sample holder, with the second electrode disposed between the first electrode and the detector; and in a region where said electrodes diverge from one another and said detector diverges from said electrodes, the second electrode is at least partially transparent to electrons such that, in use, electrons entering said electric field through said gap are deflected to pass through the second electrode and impinge upon the detector, which is operative to detect the impinging electrons.

2. A spectrometer according to claim 1, wherein said electrodes are frusto-conical.

3. A spectrometer according to claim 1, wherein the apexes of the respective cones of said electrodes meet at or adjacent a surface of a sample when held in said sample holder.

4. A spectrometer according to claim 1, wherein the detector has a shape which is similar to that of said electrodes.

5. A spectrometer according to claim 1, wherein the detector is coaxial with said electrodes.

6. A spectrometer according to claim 1, further comprising a first screen which is disposed between said second electrode and detector, and is arranged to be biassed to the same potential as said second electrode.

7. A spectrometer according to claim 6, wherein the first screen has a shape which is similar to that of said detector and electrodes.

8. A spectrometer according to claim 6, wherein the first screen is coaxial with said detector and electrodes.

9. A spectrometer according to claim 6, further comprising a second screen which is disposed between said first screen and detector, and is arranged to be biassed to a potential which is negative with respect to that of said first screen.

10. A spectrometer according to claim 9, wherein the second screen has a shape which is similar to that of said first screen, detector and electrodes.

11. A spectrometer according to claim 9, wherein the second screen is coaxial with said first screen, detector and electrodes.

12. A spectrometer according to claim 1, wherein said detector includes a light-emitting screen and means for detecting said light.

13. A spectrometer according to claim 1, wherein said detector includes an array of charge-coupled devices.

14. A spectrometer according to claim 1, including processing means for receiving from said detector signals representing the distribution of electrons in said detector, and for processing said signals to provide a spectrum of the energy levels of said electrons.

15. Use of a spectrometer according to claim 1 to carry out a spectral analysis of a sample, comprising the steps of:

holding the sample in the sample holder;

emitting an excitation beam from the excitation source to the sample in said holder thereby to cause electron emission from the sample;

establishing an electric field between said electrodes by means of the biassing means;

detecting, by means of the detector, electrons which enter said electric field through said gap and are deflected to pass through the second electrode and impinge upon the detector; and processing signals received from said detector to provide a spectrum of the energy levels of the electrons that have impinged upon said detector.

16. A spectrometer according to claim 1, comprising an interface for defining said gap between said electrodes, which interface companies a plate having first and second surface portions which border first and second electric field regions respectively, at least said first surface portion comprising an electrically resistive material the resistance of which varies over said surface portion so as to terminate and match over said surface portion equipotentials in the first electric field region.

17. An interface according to claim 16, wherein said second surface portion comprises an electrically conductive portion, to provide a termination where the electric field in said second region is a zero field.

18. Apparatus according to claim 17, wherein said plate is disposed at adjacent ends of said electrodes.

* * * * *